US006928787B2

(12) United States Patent
Shibazaki et al.

(10) Patent No.: US 6,928,787 B2
(45) Date of Patent: Aug. 16, 2005

(54) BANDING PACKING MACHINE

(75) Inventors: Tokio Shibazaki, Kawasaki (JP); Kenichi Enda, Kawasaki (JP); Yoshikatsu Aizawa, Kawasaki (JP); Saburo Tsurumaki, Chiba (JP); Mitsuru Sato, Kawasaki (JP); Shigeru Oofukuji, Kawasaki (JP); Eiji Tobita, Kawasaki (JP); Hirohiko Kusuhata, Kawasaki (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 10/675,519

(22) Filed: Sep. 30, 2003

(65) Prior Publication Data

US 2004/0060267 A1 Apr. 1, 2004

(30) Foreign Application Priority Data

Sep. 30, 2002 (JP) ..... 2002-286693
Sep. 2, 2003 (JP) ..... 2003-310525

(51) Int. Cl.[7] ..... B65B 13/04; B65B 57/02

(52) U.S. Cl. ..... 53/64; 53/589; 53/389.1; 100/4; 100/26; 100/32; 226/118.4

(58) Field of Search ..... 53/64, 589, 389.1, 53/389.4; 100/4, 26, 29, 32, 33 PB; 226/118.4

(56) References Cited

U.S. PATENT DOCUMENTS 3,137,426 A * 6/1964 Brenneisen ..... 100/26
3,946,921 A 3/1976 Noguchi
4,120,239 A * 10/1978 Pasic et al. ..... 100/26
4,155,799 A * 5/1979 Matsushita et al. ..... 53/589
4,271,655 A * 6/1981 Nagayoshi ..... 53/589
4,559,767 A * 12/1985 Takami ..... 53/589
4,691,498 A * 9/1987 Stamm ..... 53/589
5,112,004 A * 5/1992 Tipton ..... 226/118.4
5,379,576 A * 1/1995 Koyama ..... 53/589
5,442,899 A * 8/1995 Shibazaki et al. ..... 53/589
5,467,701 A * 11/1995 Bartzick et al. ..... 100/4
5,651,306 A * 7/1997 Hoshino ..... 100/26
6,038,967 A 3/2000 Chak et al.
6,076,338 A * 6/2000 Maeda et al. ..... 53/589
6,609,351 B2 * 8/2003 Shibazaki et al. ..... 53/64
6,622,619 B1 * 9/2003 Liu et al. ..... 100/4
6,655,117 B2 * 12/2003 Hoshino ..... 53/589
6,662,713 B2 * 12/2003 Kawabata et al. ..... 100/4
6,715,408 B1 * 4/2004 Rossi ..... 100/32
6,766,624 B2 * 7/2004 Shibazaki et al. ..... 53/589

FOREIGN PATENT DOCUMENTS

EP 0 596 288 A2 5/1994
EP 0 604 783 A 7/1994
EP 1 298 059 A 4/2003
GB 2 019 040 A 10/1979
JP 03111220 A * 5/1991 ..... B65B/13/18
JP 2003-267305 A 9/2003

OTHER PUBLICATIONS

Taiwanese Patent Publication No. 366888 (4 pp.) and English translation of claim 1.

* cited by examiner

*Primary Examiner*—Stephen F. Gerrity
(74) *Attorney, Agent, or Firm*—The Webb Law Firm, P.C.

(57) ABSTRACT

A banding packing machine capable of inexpensively detecting the end of a band reel, thereby contributing to a reduction in cost. In a banding packing machine having a back pool box in a packing machine body and serving to feed an unused band (B) stored in the back pool box and a band from a band reel, the rotating speed of a touch roller is detected when a required amount of band is being pulled out of the band reel wherein the band is not left in the band reel if the rotating speed is not changed but the rotation is carried out at an almost constant speed, and the tip portion of the band does not arrive at the predetermined position of a band guide arch. Then, the driving operation of a normal rotating roller is stopped based on the decision signal.

24 Claims, 5 Drawing Sheets

BANDING PACKING MACHINE

BACKGROUND OF THE INVENTION

1. Field of the Invention

The present invention relates to a banding packing machine, and more particularly to an automatic banding packing machine comprising a band guide arch and serving to automatically detect that a band is not left in a band reel and the band in the band reel is used up in a series of operations for feeding the band toward the band guide arch side and pulling back the band from the band guide arch.

2. Description of the Related Art

For example, some automatic banding packing machines accommodate, in a packing machine body, a band reel around which the band is wound in a large amount (Japanese Patent Application No. 2002-67089).

In such a banding packing machine, the band reel is not protruded from the side surface of the packing machine body. Therefore, there is an advantage that a whole shape is small-sized.

On the other hand, in the conventional banding packing machine, a great deal of force is required for directly pulling a band out of the band reel and feeding the band toward the band guide arch side. Therefore, a primary storage chamber for a band having a small capacity which is referred to as a pool box or a back pool box is provided in the packing machine body.

The amount of the band required for banding at several times is prestored in the pool box. In the case in which the pool box is to be provided, moreover, a pool feed motor is disposed between the band reel and the pool box. The band is fed from the band reel into the pool box by the driving force of the rotating shaft of the pool feed motor.

On the other hand, in the case in which the back pool box is to be provided, only the excess of the band pulled back by one-time banding is stored in the back pool box. More specifically, the amount of the band required for banding at several times is not stored in the back pool box differently from the pool box.

In the banding packing machine provided with the primary storage chamber for the band which is referred to as the pool box or the back pool box, thus, the excess of the band left in the pool box or the back pool box is used for next banding.

In some cases in which the banding is to be newly carried out in the banding packing machine, however, the excess of the band stored in the pool box, particularly, in the back pool box causes a length to be insufficient. Accordingly, an amount of band further required should be directly pulled out from the band reel so as to be used.

In such a banding packing machine, the band prestored in the pool box or the back pool box is fed toward the band guide arch side with a small torque at a high speed, and the further required amount of band is pulled out from the band reel with a great torque at a low speed.

In such a conventional banding packing machine, it is detected in the following manner that the band reel accommodated in the banding packing machine body becomes empty and is to be replaced.

More specifically, for example, a photoelectric switch or a proximity switch is provided in a band running path on the way from the band reel to the back pool box, and the presence of the band is detected by means of the switch.

When the signal is detected, it is decided that the band is used up and the subsequent operations of the banding packing machine are stopped. Thus, the final end of the band can be prevented from being fed into the band guide arch.

In order to detect that the band reel thus becomes empty, that is, the band is used up, however, the photoelectric switch or the proximity switch is conventionally required. Correspondingly, there is a problem in that a cost is increased.

SUMMARY OF THE INVENTION

In consideration of such actual circumstances, it is an object of the present invention to provide a banding packing machine capable of inexpensively detecting the end of a band reel and contributing to a reduction in a cost.

In order to attain the object, the present invention provides a banding packing machine in which a common touch roller provided to freely come in pressure contact with and separate from a normal rotating roller and a reverse rotating roller;

band feeding means constituted by causing the common touch roller to come in pressure contact with the normal rotating roller and serving to feed a tip of a band in a packing machine body toward a band guide arch side;

detecting means for detecting that the tip portion of the band arrives at a predetermined position of the band guide arch;

band pulling back means constituted by causing the common touch roller to come in pressure contact with the reverse rotating roller and serving to pull back the band fed toward the band guide arch side based on a signal generated from the detecting means;

band tightening means for tightening the band thus pulled back; and a back pool box or a pool box which is partitioned in the packing machine body for temporarily storing the unused band pulled back by the band pulling back means and the band tightening means, in which when the unused band stored in the back pool box or the pool box is to be used for next banding, said unused band is fed toward the band guide arch side by driving force of the band feeding means including the normal rotating roller and the common touch roller, and an amount of band further required is reeled out directly from a band reel toward the band guide arch side and is thus fed toward the guide arch side, wherein a rotating speed of driving means for rotating the band reel is detected by speed detecting means when the further required amount of band is being directly reeled out from the band reel toward the band guide arch side, and it is decided that the band is left in the band reel if the rotating speed of the driving means is changed, and it is decided that the band is not left in the band reel if the rotating speed of the driving means is not changed but the rotation is carried out at an almost constant speed.

It is preferable that a detected portion of the driving means from which the change in the rotating speed is detected should be the common touch roller constituting the band supply means. In such a case, it is possible to preferably employ the detected portion for the banding packing machine comprising the back pool box.

Moreover, a detected portion of the driving means from which the change in the rotating speed is detected may be a pool feed touch roller coming in pressure contact with a rotating shaft of a pool feed motor which is provided for reeling out the band from the band reel to the pool box.

In such a case, it is possible to preferably employ the detected portion for the banding packing machine comprising the pool box.

Furthermore, it is preferable that the means for detecting a rotating speed should be a proximity switch.

If the rotating speed is detected by the proximity switch, thus, the structure can easily be obtained inexpensively.

According to the banding packing machine having the structure described above, if the rotating speed of the detected portion of the driving means for directly rotating the band reel is detected and the presence of a change in the rotating speed is detected by the speed detecting means, the end of the band reel can be detected.

More specifically, in the case in which the rotation is carried out at an almost constant speed and the rotating speed is not changed, it can be decided that the band wound around the band reel has already been used up, and the termination of the band is separated from the band reel and the band reel is not rotated. Accordingly, the operation for feeding the band can be stopped based on the signal.

Moreover, the present invention provides a banding packing machine in which a common touch roller provided to freely come in pressure contact with and separate from a normal rotating roller and a reverse rotating roller;

band feeding means constituted by causing the common touch roller to come in pressure contact with the normal rotating roller and serving to feed a tip of a band in a packing machine body toward a band guide arch side;

detecting means for detecting that the tip portion of the band arrives at a predetermined position of the band guide arch;

band pulling back means constituted by causing the common touch roller to come in pressure contact with the reverse rotating roller and serving to pull back the band fed toward the band guide arch side based on a signal generated from the detecting means;

band tightening means for tightening the band thus pulled back; and a back pool box or a pool box which is partitioned in the packing machine body for temporarily storing the unused band pulled back by the band pulling back means and the band tightening means, in which the unused band stored in the back pool box or the pool box is to be used for next banding, said unused band is fed toward the band guide arch side by driving force of the band feeding means including the normal rotating roller and the common touch roller, and an amount of band further required is reeled out directly from a band reel toward the band guide arch side and is thus fed toward the band guide arch side, wherein a rotating speed of driving means for rotating the band reel is detected by speed detecting means when the further required amount of band is being directly reeled out from the band reel toward the band guide arch side, and it is decided that the band is left in the band reel if the rotating speed of the driving means is changed, it is decided that the band is left in the band reel if the rotating speed of the driving means is not changed but the rotation is carried out at an almost constant speed and arrival of the tip portion of the band at a predetermined position on the band guide arch side is detected by the detecting means, and it is decided that the band is not left in the band reel if the rotating speed of the driving means is not changed but the rotation is carried out at an almost constant speed and the arrival of the tip portion of the band at the predetermined position on the band guide arch side is not detected by the detecting means.

According to the present invention having such a structure, the same functions as those in the aforementioned banding packing machine are fulfilled. In addition, the following functions and advantages can be obtained.

More specifically, in the aforementioned banding packing machine, (1) in the case in which the tip portion of the band arrives at the predetermined position of the band guide arch and the rotating speed of the band reel is not changed, it is decided that the band is not left in the band reel. Consequently, the banding is not carried out.

In the state (1), however, the banding can be actually carried out. In the banding packing machine according to this aspect of the present invention, therefore, it is possible to correctly decide that the band is left in the band reel, whereby a banding operation can be carried out on the condition (1).

Furthermore, the present invention provides to a banding packing machine, further comprising a disk attached integrally with a rotating shaft of the common touch roller or the pool feed touch roller and provided with a notch, passage of the notch with a rotation of the rotating shaft being detected by the proximity switch, whereby a rotating speed of the common touch roller or the pool feed touch roller is detected.

Moreover, the present invention provides to a banding packing machine wherein the detection of the rotating speed of the common touch roller or the pool feed touch roller by the proximity switch is carried out at a pulse voltage in the proximity switch, it is decided that the band is left in the band reel if a pulse interval of the pulse voltage is changed, and it is decided that the band is not left in the band reel if the pulse voltage has an almost constant pulse interval.

In the banding packing machine according to the present invention, it is possible to detect the end of the band reel by simply detecting a change in the rotating speed of the touch roller. When the end of the band reel is to be detected, accordingly, a new structure is not required but it is sufficient that the rotating speed of the touch roller is still detected. Therefore, the number of components can be decreased and a cost can be reduced. In addition, this can be carried out by only electrical control. Consequently, the control can be performed very easily.

In addition, if a signal indicating whether the tip of the band arrives at the predetermined position of the band guide arch is fetched, it is possible to make a decision much more accurately. For example, even if the flexure of the band is present in the vicinity of the band reel and the secondary feeding of the band is carried out without a load applied to the band reel, it is possible to make an accurate decision that the band is still left in the band reel. In such a case, accordingly, the banding can be executed.

Moreover, the rotating speed of the driving means can easily be detected by the proximity switch.

DETAILED DESCRIPTION OF THE INVENTION

Several presently preferred embodiments of the present invention will be described below with reference to the drawings.

Figure 1:
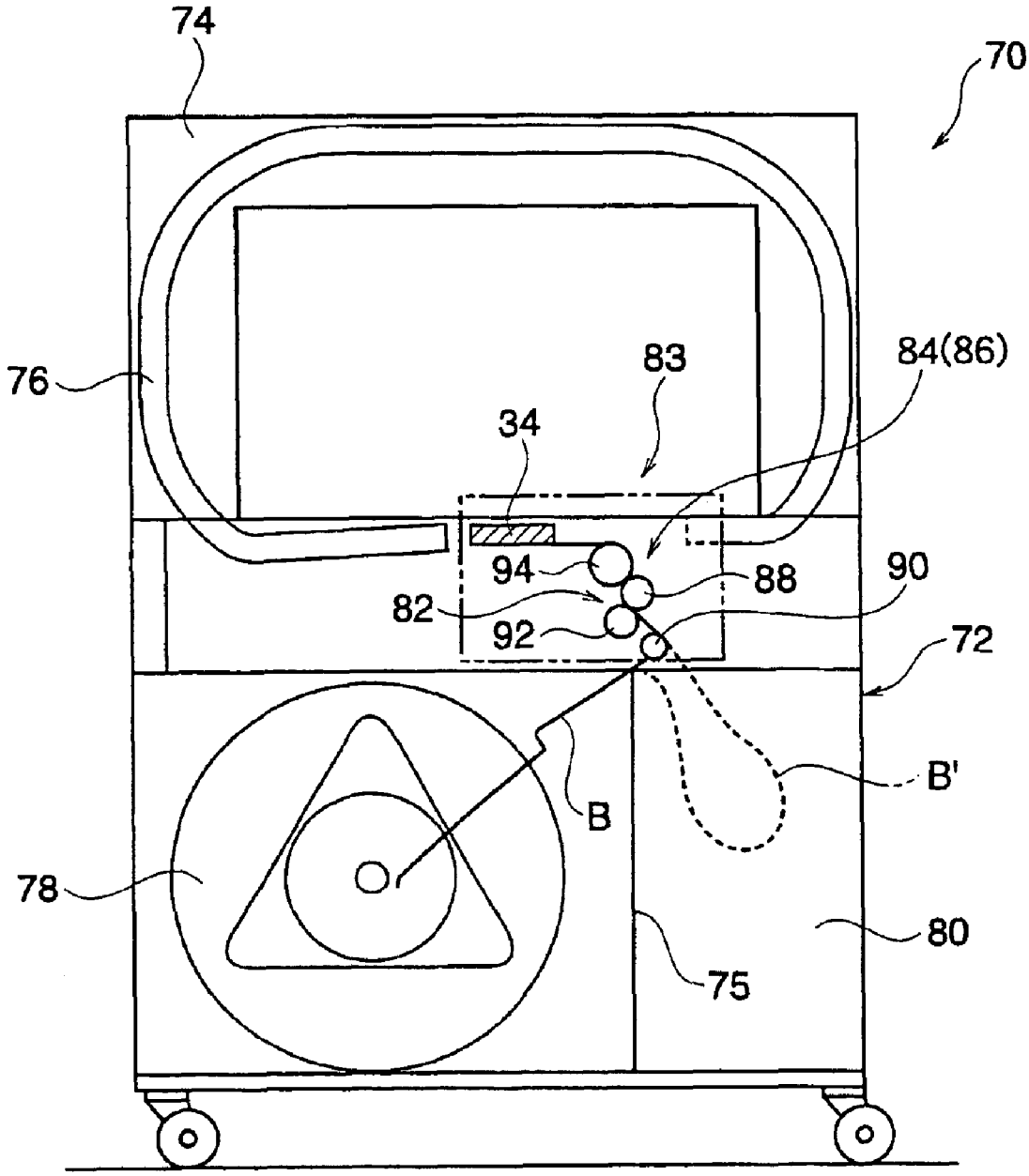
FIG. 1 is a front view showing a banding packing machine according to an embodiment of the present invention.

FIG. 1 shows a banding packing machine according to one presently preferred embodiment of the present invention.

In an automatic banding packing machine 70, an almost U-shaped band guide arch 74 is provided in the upper part of a packing machine body 72. In the band guide arch 74, a serial band passage 76 drawing a loop is formed over the packing machine body 72.

On the other hand, a band reel 78 is accommodated to be freely taken in/out of the left half part of the packing machine body 72 in FIG. 1. Moreover, a back pool box 80 is formed by a partition plate 75 in the right half part of the packing machine body 72. The back pool box 80 serves to temporarily accommodate the excess of a band B pulled back from the band guide arch 74 when banding is carried out. Accordingly, the amount of the band to be accommodated in the back pool box 80 is insufficient for next banding.

In such a banding packing machine 70, in the case in which the excess of a band left in the back pool box 80 is to be fed toward the band guide arch 74 side through band feeding means 82 comprising a pair of rollers, the feeding is carried out with a small torque at a high speed (the primary feeding of the band). On the other hand, in the case in which the excess of the band is not left in the back pool box 80, the band is to be fed with a great torque at a low speed in order to directly pull the band out from the band reel 78 (the secondary feeding of the band).

Figure 2:
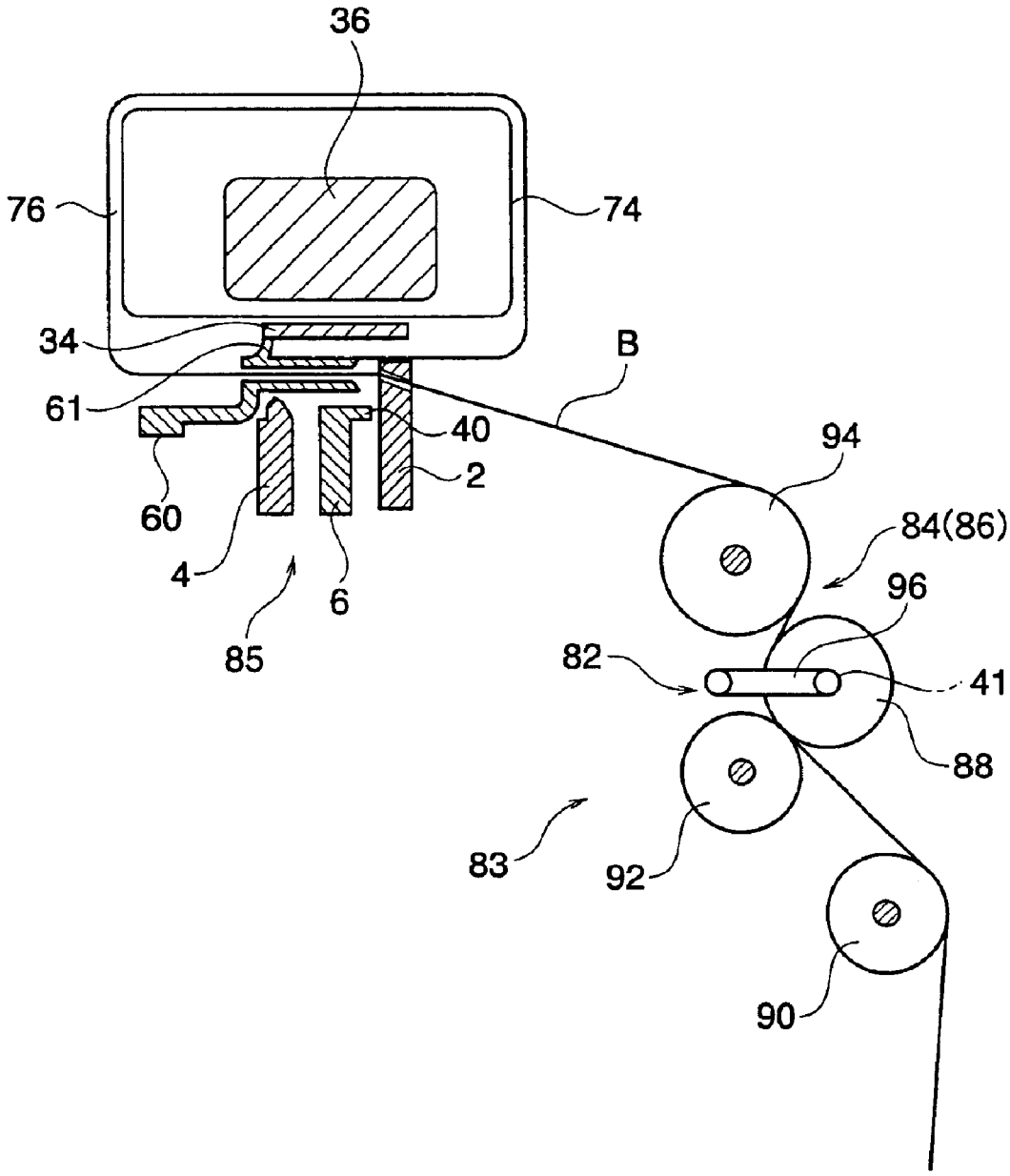
FIG. 2 is a schematic view showing the control portion of the banding packing machine in FIG. 1.

In the banding packing machine 70, moreover, a band feeding portion 83 is constituted between the back pool box 80 and a slide table 34. As shown in FIG. 2, the band feeding portion 83 has the band feeding means 82 for feeding a band toward the band guide arch 74 side through a guide roller 90, band pulling back means 84 for pulling back the band from the band guide arch 74 side, and band tightening means 86 for tightening the band thus pulled back.

The band pulling back means 84 and the band tightening means 86 are constituted by a reverse rotating roller 94 on the driving side and a common touch roller 88 on the driven side, respectively. Moreover, the common touch roller 88 also serves as the band feeding means 82 on the normal rotating side and the band pulling back means 84 on the reverse rotating side (the band tightening means 86). In addition, the common touch roller 88 is caused to selectively come in contact with one of rollers 92 and 94 on the driving side by pressure.

The common touch roller 88 is supported by a link 96 or an eccentric shaft. When the link 96 or the eccentric shaft is operated, the common touch roller 88 can be caused to come in contact with the normal rotating roller 92 or the reverse rotating roller 94 by pressure.

More specifically, the band feeding means 82 is constituted by the normal rotating roller 92 on the driving side and the common touch roller 88 on the driven side. In addition, the band pulling back means 84 and the band tightening means 86 are constituted by the reverse rotating roller 94 on the driving side and the common touch roller 88 on the driven side.

As shown in FIG. 2, in the case in which the common touch roller 88 comes in pressure contact with the normal rotating roller 92, the common touch roller 88 separates from the reverse rotating roller 94. On the contrary, in the case in which the common touch roller 88 comes in pressure contact with the reverse rotating roller 94, the common touch roller 88 separates from the normal rotating roller 92.

When the common touch roller 88 is caused to come in pressure contact with the reverse rotating roller 94, the band can be pulled back and tightened.

On the other hand, a right presser member 2, a left presser member 4 and a middle presser member 6 for carrying out the operations for clamping, welding and cutting the tip portion of the band by the action of a cam are arranged straight in an almost horizontal direction below the band guide arch 74. These three members are constituted to be vertically moved in predetermined timings in conformity with the shape of a cam disposed on a cam shaft provided in a lower part.

Furthermore, a band guide 60 to freely appear in an almost horizontal direction is provided below the slide table 34. The band guide 60 is provided with a stopper 61 mounting a limit switch thereon.

More specifically, in a control portion 85, when the tip portion of the band is fed toward the band guide arch 74 side by the band feeding means 82 and the tip portion of the band abuts on the stopper 61 of the band guide 60, the limit switch is turned ON and the band is started to be pulled back and tightened based on the signal. First of all, when the tip of the band arrives at the stopper 61, the right presser member 2 is lifted so that the tip portion of the band is interposed between the right presser member 2 and the slide table 34.

Then, the band guide 60 is moved backward from the vicinity of the slide table 34. When the tip portion of the band B is interposed between the right presser block 2 and the slide table 34, the band B is pulled back toward the back pool box 80 side by the band pulling back means 84.

Thereafter, secondary tightening is carried out by the band tightening means 86 and the left presser member 4 is lifted to press the band B together with the slide table 34. Consequently, the band is maintained in the tightening state and the middle presser member 6 positioned in a lower part is then lifted to cut the band by means of a cutter 40. Furthermore, a heater to freely appear is inserted in the superposing portion of the band in an almost horizontal direction and the surface of the band is molten by means of the heater. Subsequently, the middle presser member 6 is further lifted to press and fix the band B by pressure together with the slide table 34.

In the banding packing machine 70 in accordance with the present embodiment, each of the normal rotating roller 92 and the reverse rotating roller 94 is constituted to be rotated at a rotating speed in two stages by well-known means. When they are rotated at a high speed, a torque is small. When they are rotated at a low speed, the torque is great.

More specifically, in the case in which the normal rotating roller 92 is rotated at a high speed, the band can be quickly fed toward the band guide arch 74 side between the normal rotating roller 92 and the common touch roller 88. At this time, the rotating torque of the normal rotating roller 92 is small. Accordingly, such a condition is suitable for the case in which the excess of the band left in the back pool box 80 shown in FIG. 1 is fed toward the band guide arch 74 side (the primary feeding of the band).

On the other hand, in the case in which the normal rotating roller 92 is rotated at a low speed, the band can be fed slowly toward the band guide arch 74 side. At this time, the rotating torque of the normal rotating roller 92 is increased. Therefore, such a condition is suitable for the case in which the excess of the band is not present in the back pool box 80 any longer and the band is directly pulled out from the band reel 78 and the band is thus fed toward the band guide arch 74 side (the secondary feeding of the band).

Next, the case of pulling back and tightening of the band will be described.

If the common touch roller 88 is caused to come in pressure contact with the reverse rotating roller 94, the band can be pulled back and tightened.

First of all, the reverse rotating roller 94 is rotated at a high speed so that the band can be quickly pulled back between the reverse rotating roller 94 and the common touch roller 88. At this time, moreover, the rotating torque of the reverse rotating roller 94 is small. Therefore, such a condition is suitable for pulling back the band after feeding the band toward the band guide arch 74 side (the primary tightening of the band).

Furthermore, when the reverse rotating roller 94 is rotated at a low speed, the band can be slowly pulled back between the reverse rotating roller 94 and the common touch roller 88. At this time, the rotating torque of the reverse rotating roller 94 is set to be great. Therefore, such a condition is suitable for tightening the band following the pulling back of the band (the secondary tightening of the band). On this condition, accordingly, the band can be tightened strongly.

Figure 3:
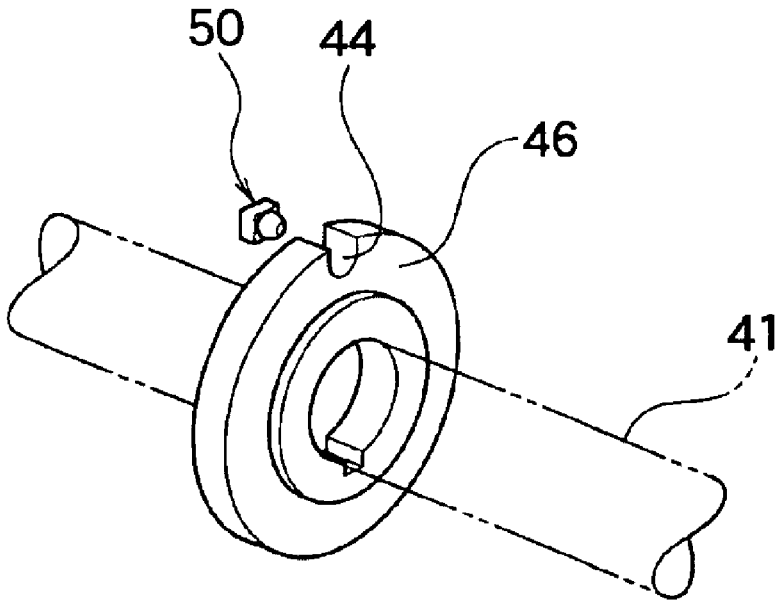
FIG. 3 is a perspective view showing a disk supported on a rotating shaft in order to detect the number of rotations of a touch roller.

In such a banding packing machine 70, conventionally, in the case in which the band is to be fed or tightened in order to carry out various control operations, the number of rotations of the common touch roller 88, the rotating speed thereof and the like are detected. More specifically, in the banding packing machine 70, as shown in FIG. 3, a disk 46 provided with a notch 44 is attached integrally with a rotating shaft 41 which supports the common touch roller 88. The passage of the notch 44 with the rotation of the shaft 41 is detected by a proximity switch 50. As a result, a direction in which the touch roller 88 is rotated, and the number of rotations thereof or the like can be detected.

For example, in the banding packing machine 70, in the case in which the band B in the back pool box 80 is to be fed toward the band guide arch 74 side by the band feeding means 82, the band is fed with a small torque at a high speed by means of the normal rotating roller 92. Therefore, the rotating speed of the common touch roller 88 is increased.

On the other hand, in the secondary feeding of the band which is to be carried out after the primary feeding of the band is ended, the band is directly pulled out from the band reel 78 between the normal rotating roller 92 and the common touch roller 88 and the band is thus fed toward the band guide arch 74 side. Therefore, a load is increased when the band is to be pulled out. Consequently, a time required for one rotation of the common touch roller 88 is more prolonged.

In the present embodiment, it is detected by the proximity switch 50 that the rotating speed of the common touch roller 88 is changed during such a transition from the primary feeding of the band to the secondary feeding of the band.

Figure 4A:
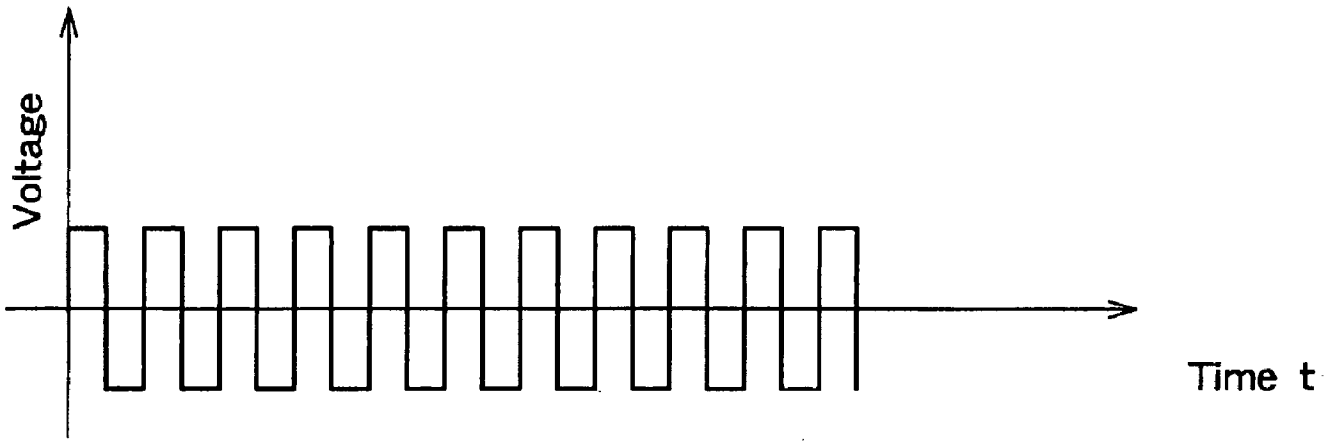
FIG. 4A is a graph representing the rotating characteristic of the touch roller in the case in which primary feeding is carried out and FIG. 4B is a graph representing the rotating characteristic of the touch roller in the case in which secondary feeding is carried out.

More specifically, as shown in FIG. 4A, in the case in which the primary feeding of the band is to be carried out, as for the voltage of the proximity switch 50 related to the passage of the time of the common touch roller 88, an almost constant pulse is confirmed in the primary feeding of the band, since the notch 44 is detected at the same rate per unit time.

Figure 4B:
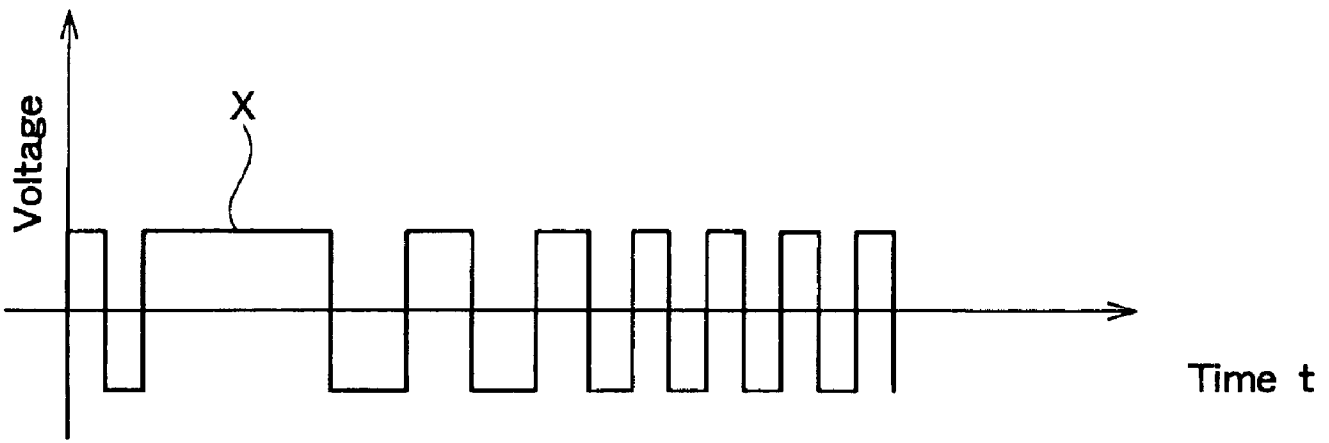

On the other hand, when the primary feeding of the band is ended and the secondary feeding of the band is started to be carried out, a long time is required before the common touch roller 88 carries out one rotation as shown in X of FIG. 4B. This time is gradually shortened, which indicates that the band reel 78 is pulled by the band and is thus started to be rotated.

In this case, it can be decided that the load of the band reel 78 is applied and the common touch roller 88 is thus rotated with a great torque at a low speed.

Subsequently, the resistance of the band reel 78 is decreased so that the rotation is carried out quickly. Thereafter, the state in which the load is not applied as shown in FIG. 4A is brought again. More specifically, a retransition from the state of FIG. 4B to that of FIG. 4A indicates that the load of the band reel 78 is eliminated. This indicates that the common touch roller 88 is rotated at the same speed per unit time.

Accordingly, in the case in which a signal in FIG. 4A appears again, the band reel 78 and the band are not rotated integrally any longer. Therefore, it can be decided that the termination of the band is separated from the band reel 78. More specifically, it can be decided that the band wound around the band reel 78 is used up.

Based on such a decision signal, the driving operation of the band feeding means 82 is temporarily stopped to end subsequent works in the present embodiment. Consequently, the final end of the band can be immediately prevented from being transferred toward the band guide arch 74 side. Accordingly, the band B stays on the way. Therefore, an operator can pull out the band by hand and can replace the band reel 78 with a new one.

In the present embodiment, thus, it is not necessary to use any new component in order to detect the end of the band reel 78. By simply identifying a change in the rotation of the common touch roller 88, it is possible to confirm a time that the band reel is to be replaced.

When the end of the band reel is detected, the driving operation of the band feeding means 82 can be stopped, and furthermore, can be output to the outside through a display, a buzzer or the like.

While the embodiment of the present invention has been described above, the present invention is not restricted thereto. For example, it is possible to further provide a mechanism for preventing a malfunction in addition to the control.

More specifically, the automatic banding packing machine 70 generally has such a structure that a band reel brake is provided for preventing the unnecessary rotation of the band reel 78. Furthermore, the unnecessary rotation of the band reel 78 can be prevented by the band reel brake.

However, in some cases in which the band brake does not fully produce effects, the band reel 78 is unnecessarily rotated so that an excessive amount of the band is reeled out around the band reel 78.

In the secondary band feeding, the insufficient band length will be usually supplemented by taking a further length directly from the band reel 78. However, when the band has loosened so long by the mechanism described above that the secondary feeding is possible without any supplementary band, the band reel will not rotate.

In that case, a pulse for a long period of time shown in X of FIG. 4B is not formed. In such a case, it is erroneously decided that the band of the band reel 78 is used up although the band is still left in the band reel 78.

Accordingly, in order to prevent the erroneous decision, whether the tip portion of the band is transferred toward the band guide arch side and is changed into a loop to reach a predetermined position can be added to criteria. In order to avoid such an erroneous decision, it is preferable to make a decision on such a condition as to add the signal of the limit switch indicating whether the band reaches the stopper 61 of the band guide 60.

More specifically, it is preferable to consider the following three conditions:

(1) the case in which the rotation of the band reel 78 is changed;

(2) the case in which the rotation of the band reel 78 is not changed and it is detected by the detecting means (the limit switch) that the tip of the band reaches the stopper 61 (ON); and (3) the case in which the rotation of the band reel 78 is not changed and it is not detected by the detecting means (the limit switch) that the tip of the band reaches the stopper 61 (OFF).

In the case (1), it is decided that the band is left in the band reel in the same manner as in the embodiment and a banding work is carried out.

In the case (2), it is decided that the band is left in the band reel 78 and a normal banding work is carried out based on the result of the decision.

In the case (3), it is decided that the band is used up and the banding is ended.

In addition to the presence of the change in the rotation of the band reel 78 in the feeding of the band, thus, whether the tip of the band reaches the stopper 61 is detected by the detecting means. Furthermore, a signal sent from the detecting means is added to the conditions. Consequently, it is possible to more accurately decide whether the band is left in the band reel 78 or is used up.

While the back pool box 80 is provided in the packing machine body 72 in the embodiment, moreover, the present invention can also be applied to a packing machine provided with a pool box in place of the back pool box 80.

Figure 5:
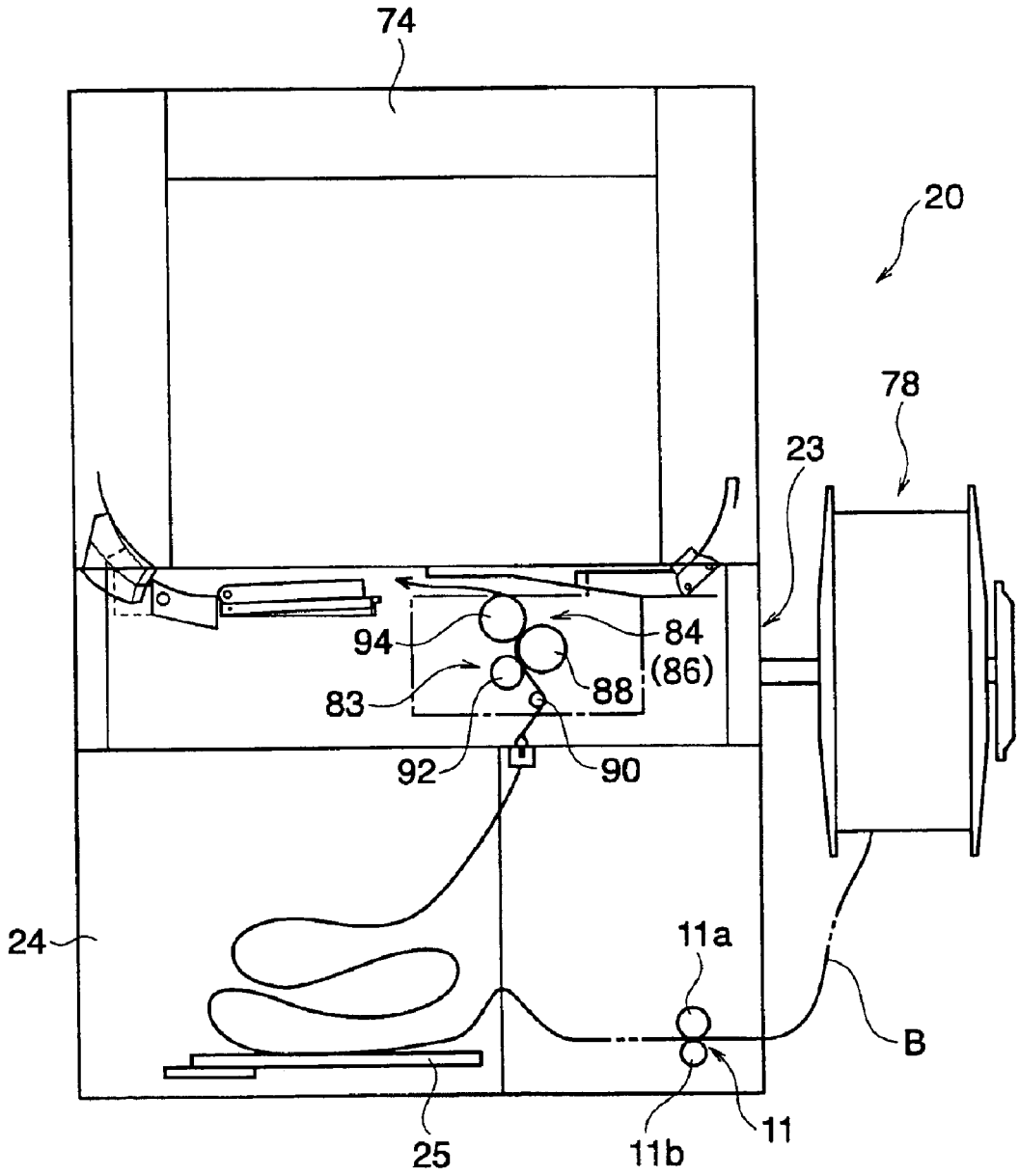
FIG. 5 is a schematic view showing a banding packing machine according to another embodiment of the present invention, particularly, a banding packing machine comprising a pool box in place of a back pool box.

More specifically, FIG. 5 shows a banding packing machine 20 comprising a pool box 24.

In the same manner as in the banding packing machine 70, the banding packing machine 20 comprises band feeding means 82, band pulling back means 84, band tightening means 86, a band guide arch 74 and the like.

In the banding packing machine 20, moreover, the pool box 24 is provided in a left half part in a packing machine body 23 in place of the back pool box. Furthermore, a band reel 78 is provided on the outside of the packing machine body 23.

Such a banding packing machine 20 comprises a pool feed roller 11 to be driving means for leading the band B from the band reel 78 into the pool box 24.

The pool feed roller 11 is constituted by a driving shaft 11*a* of a pool feed motor which is not shown and a pool feed touch roller 11*b* to come in pressure contact therewith. In this case, the weight of the band acting on a balance bar 25 in the pool box 24 is detected. As a result, where it is detected that the amount of the stored band is smaller than a predetermined amount, the band is directly reeled out from the band reel 78 by means of the pool feed roller 11 and is thus stored in the pool box 24.

In such a banding packing machine 20, as explained in FIG. 4, it is possible to decide whether the band is used up by detecting a change in the voltage of the proximity switch 50 relating to the passage of the time of the pool feed touch roller 11*b* for directly rotating the band reel 78 and detecting whether the tip of the band reaches the stopper 61 shown in FIG. 2 by the detecting means.

What is claimed is:

1. A banding packing machine comprising:

a common touch roller that comes in pressure contact with and separates from a normal rotating roller and a reverse rotating roller;

band feeding means for causing the common touch roller to come in pressure contact with the normal rotating roller and for feeding a tip portion of a band in a packing machine body toward a band guide arch side;

detecting means for detecting that the tip portion of the band arrives at a predetermined position on the band guide arch;

band pulling back means for causing the common touch roller to come in pressure contact with the reverse rotating roller and for pulling back the band fed toward the band guide arch side based on a signal generated from the detecting means;

band tightening means for tightening the band pulled back by the band pulling back means;

one of a back pool box or a pool box which is partitioned in the packing machine body for temporarily storing the unused band pulled back by the band pulling back means and the band tightening means; and rotation speed detection means for detecting the rotation speed of the band feeding means, the band feeding means is contracted when the unused band stored in one of the back pool box or the pool box is to be used for a next banding process, said tip portion of the band is fed toward the band guide arch side by a driving force of the normal rotating roller and the common touch roller, and the band feeding means is contracted such that an amount of band required is reeled out directly from a band reel toward the band guide arch side and is fed toward the band guide arch side, wherein the rotation speed detecting means detects a rotating speed of the band feeding means when the required amount of band is reeled out from the band reel toward the band guide arch side by the driving force of the band feeding means, and the band is left on the band reel if the rotating speed of the band feeding means detected by the rotation speed detection means is changed, and the band is not left on the band reel if the rotating speed of the band feeding means is not changed.

2. The banding packing machine according to claim 1, wherein a detected portion of the rotation speed detection means is the common touch roller.

3. The banding packing machine according to claim 2, wherein the rotation speed detection means is a proximity switch.

4. The banding packing machine according to claim 2, comprising a disk attached integrally with a rotating shaft of the common touch roller or a pool feed touch roller and provided with a notch, wherein the passage of the notch with a rotation of the rotating shaft is detected by a proximity switch, whereby a rotating speed of the common touch roller or the pool feed touch roller is detected.

5. The banding packing machine according to claim 1, wherein a detected portion of the rotation speed detection means is a pool feed touch roller, which comes in pressure contact with a rotating shaft of a pool feed motor provided for reeling out the band from the band reel to the pool box.

6. The banding packing machine according to claim 5, wherein the rotation speed detection means is a proximity switch.

7. The banding packing machine according to claim 5, comprising a disk attached integrally with a rotating shaft of the common touch roller or the pool feed touch roller and provided with a notch, wherein the passage of the notch with a rotation of the rotating shaft is detected by a proximity switch, whereby a rotating speed of the common touch roller or the pool feed touch roller is detected.

8. The banding packing machine according to claim 1, wherein the rotation speed detection means is a proximity switch.

9. The banding packing machine according to claim 8, wherein the detection of the rotating speed of the common touch roller or a pool feed touch roller by the proximity switch is carried out at a pulse voltage in the proximity switch, and further comprising a control means for retaining the band in the band reel if a pulse interval of the pulse voltage is changed, and for permitting the removal of the band from the band reel if the pulse voltage has an almost constant pulse interval.

10. The banding packing machine according to claim 8, further comprising a disk attached integrally with a rotating shaft of the common touch roller or a pool feed touch roller and provided with a notch, wherein the passage of the notch with a rotation of the rotating shaft is detected by the proximity switch, whereby a rotating speed of the common touch roller or the pool feed touch roller is detected.

11. The banding packing machine according to claim 1, further comprising a disk attached integrally with a rotating shaft of the common touch roller or a pool feed touch roller and provided with a notch, wherein the passage of the notch with a rotation of the rotating shaft is detected by a proximity switch, whereby a rotating speed of the common touch roller or the pool feed touch roller is detected.

12. The banding packing machine according to claim 11, comprising a disk attached integrally with the rotating shaft of the common touch roller or the pool feed touch roller and provided with a notch, wherein the passage of the notch with a rotation of the rotating shaft is detected by the proximity switch, whereby the rotating speed of the common touch roller or the pool feed touch roller is detected.

13. A banding packing machine comprising:

a common touch roller that comes in pressure contact with and separates from a normal rotating roller and a reverse rotating roller;

band feeding means for causing the common touch roller to come in pressure contact with the normal rotating roller and for feeding a tip portion of a band in a packing machine body toward a band guide arch side;

detecting means for detecting that the tip portion of the band arrives at a stopper of the band guide arch;

band pulling back means for causing the common touch roller to come in pressure contact with the reverse rotating roller and for pulling back the band fed toward the band guide arch side based on a signal generated from the detecting means;

band tightening means for tightening the band pulled back by the band pulling back means;

one of a back pool box or a pool box which is partitioned in the packing machine body for temporarily storing the unused band pulled back by the band pulling back means and the band tightening means; and rotation speed detection means for detecting the rotation speed of the band feeding means, the band feeding means is contracted when the unused band stored in one of the back pool box or the pool box is to be used for a next banding process, said tip portion of the band is fed toward the band guide arch side by a driving force of the normal rotating roller and the common touch roller, and the band feeding means is contracted such that an amount of band required is reeled out directly from a band reel toward the band guide arch side and is thus fed toward the guide arch side, wherein the rotation speed detecting means detects a rotating speed of the band feeding means when the required amount of the band is reeled out from the band reel toward the band guide arch side by the driving force of the band feeding means, and the band is left on the band reel if the rotating speed of the band feeding means detected by the rotation speed detection means is changed, and the band is not left on the band reel if the rotating speed of the band feeding means is not changed but the rotation is carried out at an almost constant speed, and the arrival of the tip portion of the band at the stopper of the band guide arch side is not detected by a band tip portion arriving detecting means.

14. The banding packing machine according to claim 13, wherein a detected portion of the rotation speed detection means is the common touch roller.

15. The banding packing machine according to claim 14, wherein the rotation speed detection means is a proximity switch.

16. The banding packing machine according to claim 14, comprising a disk attached integrally with a rotating shaft of the common touch roller or a pool feed touch roller and provided with a notch, wherein the passage of the notch with a rotation of the rotating shaft is detected by a proximity switch, whereby a rotating speed of the common touch roller or the pool feed touch roller is detected.

17. The banding packing machine according to claim 13, wherein a detected portion of the rotation speed detection means is a pool feed touch roller, which comes in pressure contact with a rotating shaft of a pool feed motor provided for reeling out the band from the band reel to the pool box.

18. The banding packing machine according to claim 17, wherein the rotation speed detection means is a proximity switch.

19. The banding packing machine according to claim 17, comprising a disk attached integrally with a rotating shaft of the common touch roller or the pool feed touch roller and provided with a notch, wherein the passage of the notch with a rotation of the rotating shaft is detected by a proximity switch, whereby a rotating speed of the common touch roller or the pool feed touch roller is detected.

20. The banding packing machine according to claim 13, wherein the rotation speed detection means is a proximity switch.

21. The banding packing machine according to claim 20, wherein the detection of the rotating speed of the common touch roller or the pool feed touch roller by the proximity switch is carried out at a pulse voltage in the proximity switch, and a control means provided for retaining the band in the band reel if a pulse interval of the pulse voltage is changed, and permitting the removal of the band from the band reel if the pulse voltage has an almost constant pulse interval.

22. The banding packing machine according to claim 20, comprising a disk attached integrally with a rotating shaft of the common touch roller or a pool feed touch roller and provided with a notch, wherein the passage of the notch with a rotation of the rotating shaft is detected by the proximity switch, whereby a rotating speed of the common touch roller or the pool feed touch roller is detected.

23. The banding packing machine according to claim 13, further comprising a disk attached integrally with a rotating shaft of the common touch roller or a pool feed touch roller and provided with a notch, wherein the passage of the notch with a rotation of the rotating shaft is detected by a proximity switch, whereby a rotating speed of the common touch roller or the pool feed touch roller is detected.

24. The banding packing machine according to claim 23, comprising a disk attached integrally with the rotating shaft of the common touch roller or the pool feed touch roller and provided with a notch, wherein the passage of the notch with a rotation of the rotating shaft is detected by the proximity switch, whereby a rotating speed of the common touch roller or the pool feed touch roller is detected.

* * * * *